US007552844B2

(12) United States Patent
Drennow

(10) Patent No.: US 7,552,844 B2
(45) Date of Patent: Jun. 30, 2009

(54) COUPLING ARRANGEMENT, COUPLING DEVICES AND USE OF COUPLING DEVICE

(76) Inventor: Sten Drennow, Östervångsvägen 4, S-224 60 Lund (SE)

( * ) Notice: Subject to any disclaimer, the term of this patent is extended or adjusted under 35 U.S.C. 154(b) by 569 days.

(21) Appl. No.: 11/330,618

(22) Filed: Jan. 12, 2006

(65) Prior Publication Data

US 2006/0201965 A1 Sep. 14, 2006

(30) Foreign Application Priority Data

Mar. 11, 2005 (SE) ..... 0500551

(51) Int. Cl.
*B67D 5/00* (2006.01)

(52) U.S. Cl. ..... 222/83; 222/81; 222/105; 222/153.06; 222/569

(58) Field of Classification Search ..... 222/74, 222/81–83, 83.5, 105, 107, 153.06, 183, 222/569

See application file for complete search history.

(56) References Cited

U.S. PATENT DOCUMENTS 2,350,451 A * 6/1944 Embrey ..... 222/81
2,873,885 A * 2/1959 Heller ..... 222/81
3,108,717 A * 10/1963 Kindseth ..... 222/89
3,404,811 A * 10/1968 Cernei ..... 222/83
4,603,793 A * 8/1986 Stern ..... 222/105
4,776,488 A * 10/1988 Gurzan ..... 222/81
5,025,945 A * 6/1991 Lyon ..... 220/740
5,127,550 A * 7/1992 Knorr ..... 222/83
5,141,133 A * 8/1992 Ninomiya et al. ..... 222/83
5,147,070 A * 9/1992 Iwamoto ..... 222/83
5,366,114 A * 11/1994 Bernstein et al. ..... 222/83
5,452,826 A * 9/1995 Stern ..... 222/207
5,467,581 A * 11/1995 Everette ..... 53/133.2
5,482,176 A * 1/1996 Maietta et al. ..... 220/277
5,573,047 A * 11/1996 Akin ..... 141/330
5,947,318 A * 9/1999 Palm ..... 220/278

(Continued)

FOREIGN PATENT DOCUMENTS

WO WO 02/26586 A1 4/2002

(Continued)

*Primary Examiner*—Kevin P Shaver
*Assistant Examiner*—Andrew P Bainbridge
(74) *Attorney, Agent, or Firm*—Tarolli, Sundheim, Covell & Tummino LLP

(57) ABSTRACT

A coupling arrangement (5) includes an inner coupling device (9) within a package (1) and an outer coupling device (12) on a withdrawal arrangement (4). The outer coupling device (12) includes a tube section (14) that can break a wall of a package (1) and be introduced into a hole (15) in a part (10) of the inner coupling device (9). At least one protruding part (16) is arranged on and/or beside the tube section (14) of the outer coupling device (12). At least one hole (17) and/or a thin section (18) of wall is arranged in the part (10) of the inner coupling device (9). The protruding part (16) can be introduced into the hole (17) and/or break the thin section (18) of wall in order to allow coupling of the outer coupling device (12) and the inner coupling device (9). The protruding part (16) may prevent coupling of the inner coupling device (9) and the outer coupling device (12) if the part (10) provided with holes lacks the hole (17) and the thin section (18).

21 Claims, 3 Drawing Sheets

U.S. PATENT DOCUMENTS

| | | | | |
|---|---|---|---|---|
| D418,413 | S * | 1/2000 | Stern | D9/434 |
| 6,056,142 | A * | 5/2000 | Elliott | 220/278 |
| 6,098,845 | A * | 8/2000 | Stern | 222/83 |
| 6,227,410 | B1 * | 5/2001 | Stern | 222/1 |
| 6,354,466 | B1 * | 3/2002 | Karpisek | 222/83 |
| 6,460,732 | B1 * | 10/2002 | Drennow | 222/83 |
| 6,860,407 | B2 * | 3/2005 | Gosselin | 222/105 |
| 7,011,233 | B2 * | 3/2006 | Drennow | 222/105 |
| 7,188,749 | B2 * | 3/2007 | Miller et al. | 222/1 |
| 7,395,947 | B2 * | 7/2008 | Drennow | 222/95 |
| 2002/0066677 | A1 * | 6/2002 | Moscovitz | 206/219 |
| 2003/0024947 | A1 * | 2/2003 | Joshi et al. | 222/83 |
| 2004/0026422 | A1 * | 2/2004 | Westphal | 220/277 |
| 2004/0104245 | A1 * | 6/2004 | Dubach | 222/83 |
| 2004/0104247 | A1 * | 6/2004 | Anderson | 222/83 |
| 2004/0149675 | A1 * | 8/2004 | Perry et al. | 215/228 |
| 2005/0011909 | A1 * | 1/2005 | Hanell | 222/83 |

FOREIGN PATENT DOCUMENTS

| | | |
|---|---|---|
| WO | WO 2004/037667 A1 | 5/2004 |

* cited by examiner

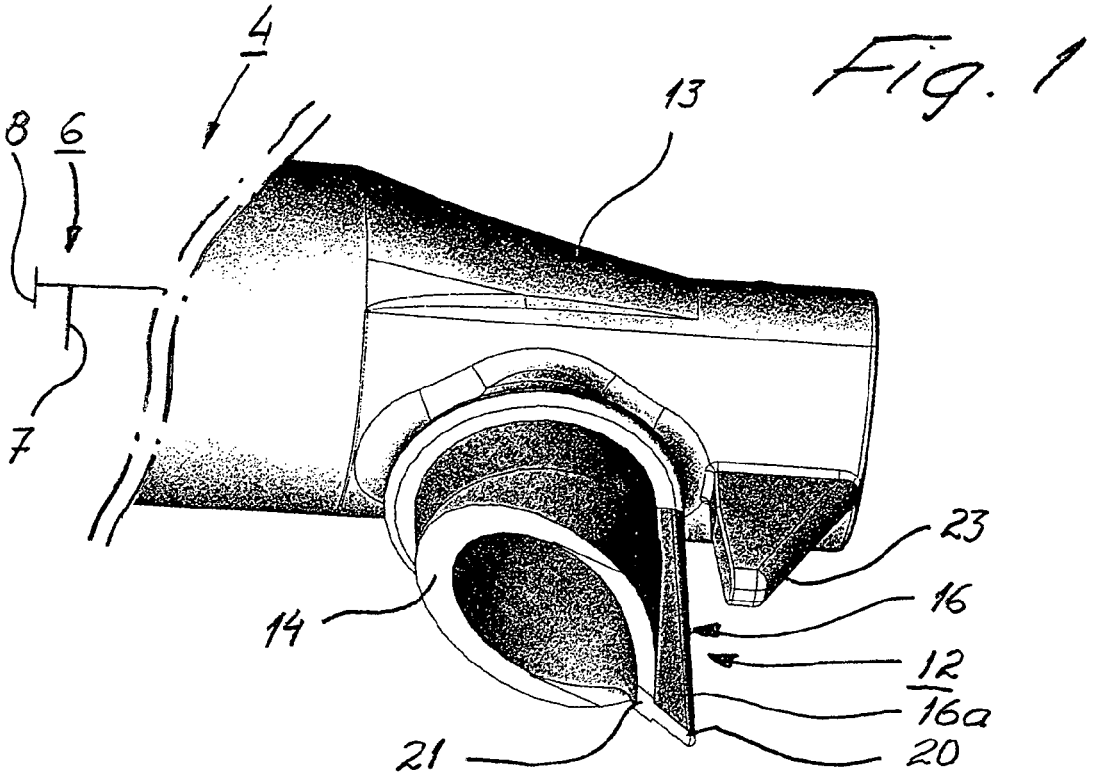
Fig. 1
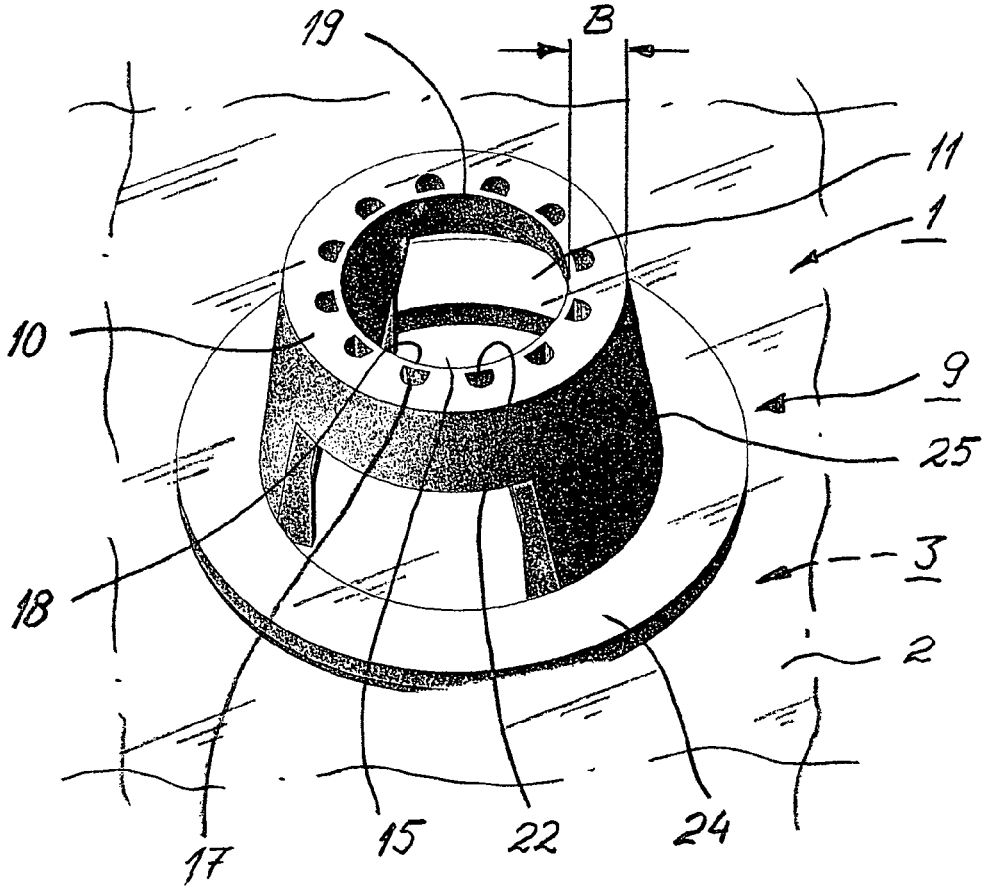

Fig. 2
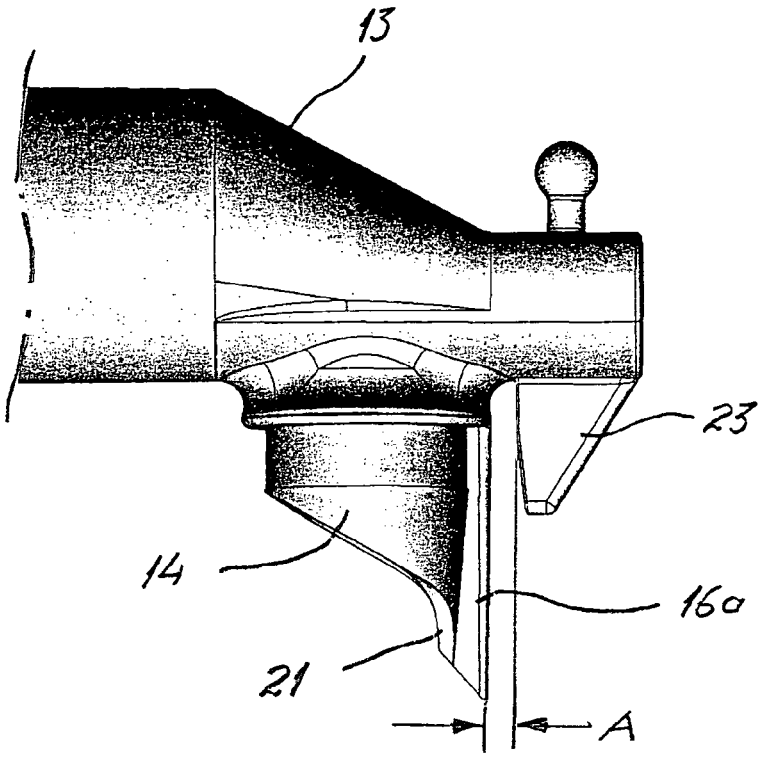
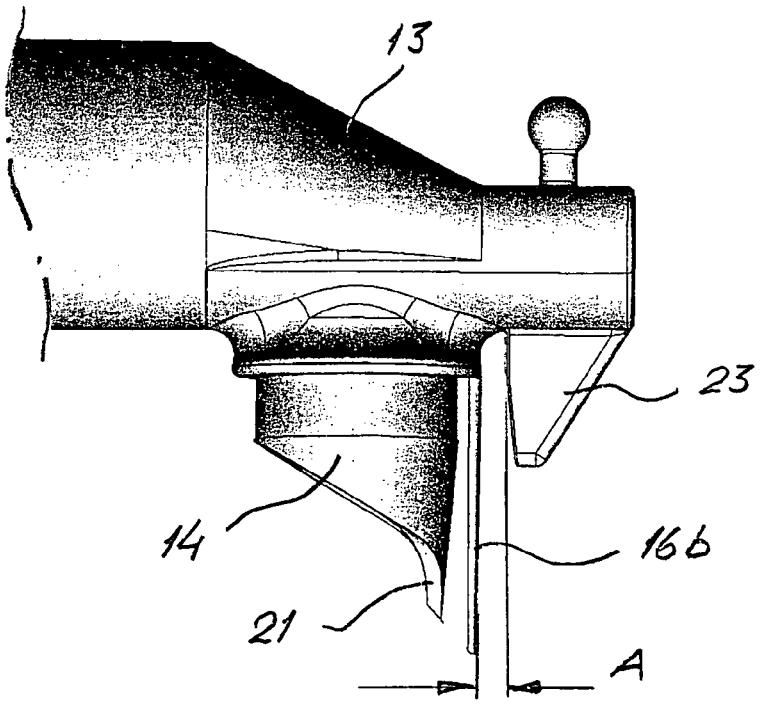
Fig. 6

COUPLING ARRANGEMENT, COUPLING DEVICES AND USE OF COUPLING DEVICE

FIELD OF THE INVENTION

The present invention relates to a coupling arrangement for coupling of a withdrawal arrangement to a package with liquid contents, through which withdrawal arrangement the contents are to be withdrawn from the package. The package consists, at least to a significant degree, of synthetic materials. The coupling arrangement comprises an inner coupling device with a part that is provided with holes and that is arranged on the inner surface of an unbroken part of the wall of the package. The coupling arrangement also comprises an outer coupling device that is arranged on the withdrawal arrangement. The outer coupling device comprises a tube section with which the unbroken part of the package can be broken and that can be introduced into the hole in the part that is provided with holes in order to be coupled to this part such that the contents of the package can be withdrawn through the tube part. The invention relates also to coupling devices and the use of a coupling device.

BACKGROUND OF THE INVENTION

Coupling arrangements of the type described in the introduction are known from the documents U.S. Pat. No. 4,603,793 and WO 2004//037667. These documents describe coupling devices of circular form or other coupling sections with simple forms, and they describe coupling devices with non-circular coupling sections with fairly complicated designs. The latter designs of the coupling sections are intended to prevent the connection of packages and withdrawal devices that are not associated with each other.

It has proved to be the case that there is a need for coupling devices that, despite being circular or other coupling sections that are of simple design, cannot or may not be connected to each other. Such coupling devices are not known.

SUMMARY OF THE INVENTION

The aim of the present invention has been to remove this deficiency, and this has been achieved through the coupling arrangement named in the introduction principally comprising the characteristics that are made clear by the attached claims 1, 18 and 21.

The coupling devices can be coupled if the outer coupling device comprises a protruding part and the inner coupling device comprises at least one of a hole and a thin section of wall that the protruding part can be brought to interact with, while the coupling devices cannot be coupled if the inner coupling device lacks the said hole or the said thin section of wall. This means that a withdrawal arrangement of a particular design cannot be coupled to certain packages, and this eliminates the risk that withdrawal devices for the withdrawal of certain contents from certain packages can be erroneously used for the withdrawal of other contents from other packages. The inner coupling device can be used for the coupling of an outer coupling device that lacks a protruding part.

BRIEF DESCRIPTION OF THE DRAWINGS

The invention will be described in more detail below with reference to the attached drawings, in which:

FIG. 1 shows in perspective views an inner and an outer coupling device according to the invention that are parts of a coupling arrangement and that are to be coupled, FIG. 2 shows a side view of the outer coupling device according to FIG. 1, FIG. 6 shows a side view of an alternative embodiment of the outer coupling device of the coupling arrangement according to the invention.

DESCRIPTION OF EXAMPLE EMBODIMENTS

Figure 5:
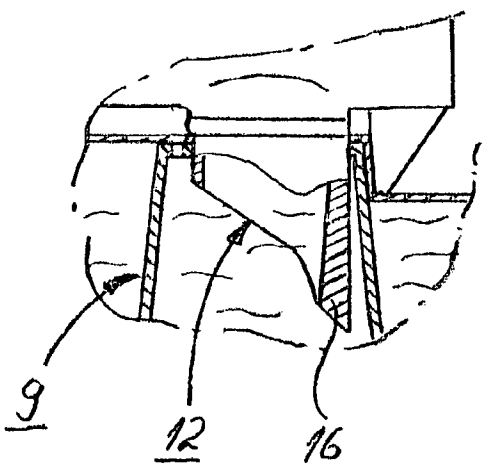
FIG. 5 shows the coupling devices according to FIG. 1 in partial cross-section after coupling.
Figure 4:
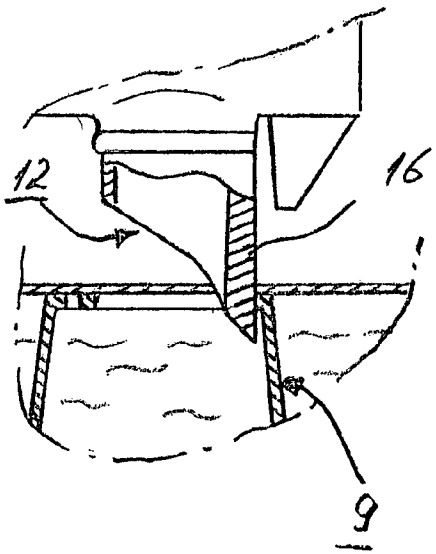
FIG. 4 shows the coupling devices according to FIG. 1 in partial cross-section during coupling.
Figure 3:
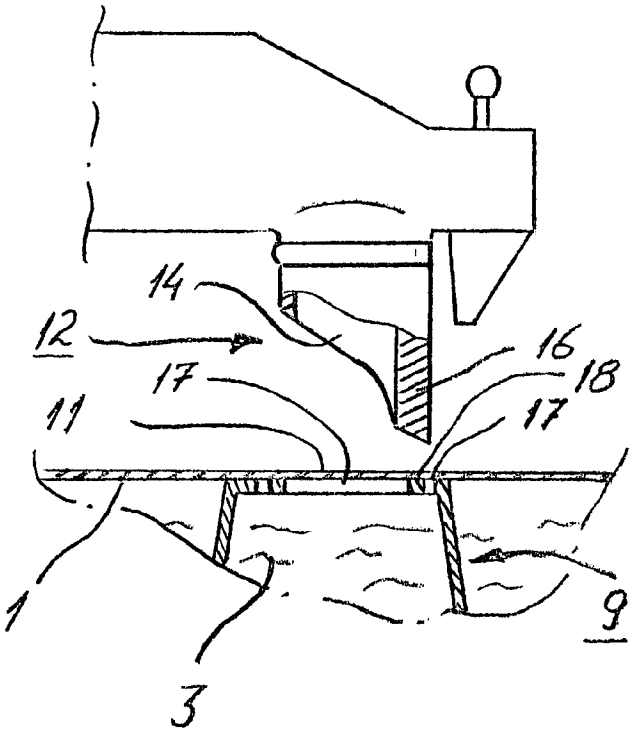
FIG. 3 shows the coupling devices according to FIG. 1 in partial cross-section before coupling.

The drawings show part 1 of a package, the walls 2 of which consist fully or partially of synthetic material and which may be, for example, a plastic bag. The contents 3 of the package 1 are liquid or essentially liquid, and may consist of foodstuffs, such as, for example, ketchup, mustard, mayonnaise, dressing, or similar.

A withdrawal arrangement 4 is intended for the withdrawal of the contents 3 from the package 1 and a coupling arrangement 5 is intended to allow coupling of the withdrawal arrangement 4 to the package 1 such that the contents 3 of the package 1 can be withdrawn from the package.

The withdrawal arrangement 4 may be a pump 6 that is partially shown in FIG. 1 and that may comprise an outlet tube 7 and a pump means 8 that can be operated manually. The pump 6 may be designed in known manner such that pumping actions of the pump means 8 withdraw contents 3 from the package 1 by suction and feed the contents out through the outlet tube 7.

The coupling arrangement 5 comprises an inner coupling device 9 that is arranged within the package 1 and that comprises a part 10 that is provided with holes, through which the inner coupling device 9 is arranged on the inner surface of an unbroken section 11 of wall of the walls 2 of the package 1.

The coupling arrangement 5 comprises furthermore an outer coupling device 12 that is arranged on the withdrawal arrangement 4, thus on the pump 6 in the design shown in the drawings. In more detail, the outer coupling device 12 is arranged on the lower part of a pump housing 13 that is part of the pump 6. The outer coupling device 12 comprises a tube section 14 with which the unbroken section 11 of the walls 2 of the package can be broken, and that can be introduced into a hole 15 in the part 10 that is provided with holes, in order to be coupled to this part such that the contents 3 of the package 1 can be withdrawn through the tube section 14.

When the unbroken part 11 of the wall is broken with the aid of the tube section 14, parts of the part 11 of the wall will be folded in into the hole 15 (these inwardly folded parts are not shown in the drawings), and the tube section 14 is pressed into the hole 15 to such an extent that it is in tight contact with the part 10 that is provided with holes.

At least one protruding part 16 is arranged on either the withdrawal arrangement 4, to be more precise at the pump housing 13 in the design that is shown in the drawings, or on the tube part 14, or on both. At least one hole 17 or at least one thin section 18 of wall, or both, is arranged in the part 10 that is provided with holes. When the coupling devices 9, 12 are coupled together, the protruding part 16 can break up the unbroken part 11 of wall outside of the hole 17 and this part can be either introduced into the hole 17 or caused to break up the thin section 18 of wall, or both, in order to allow the said coupling. If the part 10 that is provided with holes lacks both the said hole 17 and the thin section 18 of wall, the protruding part 16 will prevent the coupling devices 9, 12 from being coupled since it will come into contact with the part 10 that is provided with holes without the possibility of being able to pass through this part.

The hole 17 for the protruding part 16 is preferably arranged next to the edge 19 of the hole 15 in the part 10 that is provided with holes, and the thin section 18 of wall is preferably a section of wall between the hole 17 for the protruding part 16 and the said edge 19.

FIG. 2 makes it clear that the protruding part 16 can be a part 16*a* that is so integrated with the tube section 14 that it not only may be introduced into the hole 17 but also can be caused to break the thin section 18 of wall between the said hole 17 and the edge 19.

The part 16*a* can be designed as a flange that extends along at least significant parts of the outer surface of the tube section 14 and protrudes out in a radial direction from this tube section. The part 16*a* may, furthermore, comprise a point 20 that protrudes outwards in a direction forwards from the tube section 14, preferably forwards from such a pointed front edge 21 of this tube section that is intended to break the unbroken section 11 of wall.

The hole or holes 17 for the protruding part 16 may comprise any suitable shape, for example a circular shape, or the hole 17 can, as is shown in FIG. 1, comprise a straight edge 22 that faces the thin section 18 of wall. One or several holes 17 may be present, for example twelve such holes, and in the case in which there are several holes 17 these may be evenly distributed around the hole 15 or they may be distributed in another manner.

FIG. 6 makes it clear that it is an alternative that the protruding part 16 is a pin 16*b* that exits from the pump housing 13 and extends along the tube section 14 without being connected with this tube section. The pin 16*b* may be introduced into the hole 17 in the part 10 that is provided with holes in order to allow coupling of the coupling devices 9, 12.

Instead of holes 17 and thin sections 18 of wall, the part 10 that is provided with holes may comprise one or several other thin sections of wall (not shown in the drawings) that can be broken by the protruding part 16 independently of whether this is a part 16*a* that is connected with the tube section 14 or a pin 16*b* that is not connected with this tube section.

The pump housing 13 or equivalent may comprise at least one coupling preventing part 23 that is intended to prevent outer coupling devices 12 that comprise protruding parts 16 from being coupled to inner coupling devices that lack both holes 17 and thin sections 18 of wall for the protruding parts 16.

The coupling preventing part 23 is preferably arranged to prevent the introduction by force of an outer coupling device 12 with a protruding part 16 into the hole 15 in an inner coupling device 9 through the expansion of the part 10 that is provided with holes by force exerted by the tube section 14 and the protruding part 16. Thus, the coupling preventing part 23 is so arranged that it cannot pass the part 10 that is provided with holes if it is attempted to introduce the tube part 14 with the protruding part 16 into the hole 15 by force. The coupling preventing part 23 may be a protrusion or equivalent that protrudes from the pump housing 13 or equivalent and that extends along the tube section 14. The distance A between this coupling preventing part 23 and the protruding part 16 is preferably less than the width B of the part 10 that is provided with holes.

The coupling preventing part 23 is advantageous principally in the case in which the part 10 that is provided with holes consists of soft material whose shape can be changed by force with the aid of the outer coupling device 12 and the protruding piece 16.

FIG. 1 makes it clear that the inner coupling device 9 can consist of the part 10 that is provided with holes, which may be brought into contact with the unbroken part 11 of the wall 2 with the aid of a "plastic weld" or by another suitable means, and that may be a part with the shape of a ring with a hole 15 that is, for example, circular or essentially circular, while the tube section 14 has an equivalent shape. The inner coupling device 9 can, furthermore, comprise an inner part 24 with the shape of a ring and ribs 25 that connect this with the part 10 that is provided with holes.

The inner coupling device 9 can be used to couple to the same outer coupling device (not shown in the drawings), which comprises a tube section 14 that has a shape that is adapted to the shape of the hole 15 in the part 10 of the inner coupling device 9 that is provided with holes but that lacks one or more protruding parts 16. Several different coupling devices can in this way be coupled to the inner coupling device 9 while outer coupling devices with such forms that are to be totally prevented from being able to be coupled to the inner coupling device 9 are prevented from being coupled to it. For example, if the hole 15 of the inner coupling device 9 is circular, the outer coupling device may be cylindrical and lack protruding parts 16.

The invention is not limited to the design described above and shown in the drawings: it can vary within the framework of the attached patent claims. As examples that have not been described can be mentioned that the coupling devices 9, 12 may be arranged on other arrangements or packages than those described, the withdrawal arrangement may, for example, be a tube or a pipe instead of a pump, the protruding part of the outer coupling device may be designed or arranged in another way, and they may be designed in a different manner. Thus, there may be one or several protruding sections on the outer coupling device and there may be one or several holes in the outer coupling device for the protruding part. The withdrawal arrangement 4 can be a tap instead of a pump 6, out through which the contents 3 of the package 1 can flow when it is opened.

The invention claimed is:

1. A coupling arrangement for coupling a withdrawal arrangement (4) to a package (1) with liquid or essentially liquid contents (3), the withdrawal arrangement (4) is for withdrawing the contents (3) from the package (1), wherein:

at least significant parts of the package (1) consist of synthetic material, the package (1) comprising a plurality of walls, the coupling arrangement (5) comprises an inner coupling device (9) that is arranged within the package (1), the inner coupling device (9) comprising a part (10) that is provided with a plurality of surrounding frangibly connected holes, the inner coupling device (9) is arranged on an inner surface of an unbroken part (11) of one of the walls the walls (2) of the package (1), the coupling arrangement (5) comprises an outer coupling device (12) that is arranged on the withdrawal arrangement (4), and the outer coupling device (12) comprises a tube section (14) that breaks the unbroken part (11) of the wall of the package (1) and that is introduced into a central aperture (15) in the part (10) of the inner coupling device (9) that is provided with said plurality of surrounding frangibly connected holes in order to be coupled to the part (10) such that the contents (3) in the package (1) can be withdrawn through the tube section (14), at least one protruding part (16) is arranged on the withdrawal arrangement (4) either on or beside, or both, the tube section (14) of the outer coupling device (12), at least one of said plurality of surrounding frangibly connected holes (17) or a frangible section (18) of a wall of the part (10) or both is arranged in the part (10) of the inner coupling device (9), the protruding part (16) can be either introduced into the at least one of said plurality of surrounding frangibly connected holes (17) or caused to break the frangible section (18) of the wall, or both, in order to allow coupling of the outer coupling device (12) and the inner coupling device (9), and the protruding part (16) interacts with the part (10) that is provided with the plurality of surrounding frangibly connected holes to prevent coupling of the inner coupling device (9) and the outer coupling device (12) if the part (10) that is provided with the plurality of surrounding frangibly connected holes lacks the said plurality of surrounding frangibly connected holes (17) and said frangible section (18) of the wall for the protruding part (16).

2. The coupling arrangement according to claim 1, wherein:

the plurality of surrounding frangibly connected holes (17) for the protruding part (16) is arranged next to an edge (19) of the central aperture (15) in the part (10) that is provided with the plurality of surrounding frangibly connected holes, and the frangible section (18) of the wall is a section of the wall between the plurality of surrounding frangibly connected holes (17) for the protruding part (16) and said edge (19).

3. The coupling arrangement according to claim 1, wherein the frangible section (18) of the wall is located between said plurality of surrounding frangibly connected holes (17) and an edge (19) of the central aperture (15) in the part (10) that is provided with the plurality of surrounding frangibly connected holes, the protruding part (16) being a part (16*a*) that is connected to the tube section (14) so that the protruding part (16) can not only be introduced into the said at least one of said plurality of surrounding frangibly connected holes (17) that is intended for the protruding part (16) but also break the frangible section (18) of the wall.

4. The coupling arrangement according to claim 3, wherein the protruding part (16) protrudes in a radial direction or an essentially radial direction from the tube section (14).

5. The coupling arrangement according to claim 3, wherein the protruding part (16) comprises a point (20) that protrudes in a direction forwards from the tube section (14).

6. The coupling arrangement according to claim 5, wherein the point (20) protrudes from a pointed front edge (21) of the tube section (14) that breaks the unbroken part (11) of the wall.

7. The coupling arrangement according to claim 3, wherein the protruding part (16) extends externally along at least a significant part of the tube section (14).

8. The coupling arrangement according to claim 3, wherein the at least one of said plurality of surrounding frangibly connected holes (17) for the protruding part (16) comprises a straight edge (22) that is turned to face the frangible section (18) of the wall.

9. The coupling arrangement according to claim 1, wherein several of the plurality of surrounding frangibly connected holes (17) are available for the protruding part (16).

10. The coupling arrangement according to claim 1, wherein the outer coupling device (12) comprises the protruding part (16), at least one coupling preventing part (23) being arranged to prevent the inner coupling device (9) and the outer coupling device (12) from being coupled together if the tube section (14) and the protruding part (16) are pressed by force into the central aperture (15) in the part (10) of the inner coupling device (9) that is provided with the plurality of surrounding frangibly connected holes.

11. The coupling arrangement according to claim 10, wherein:

the coupling preventing part (23) is a part arranged on the outer coupling device (23), and the distance (A) between the coupling preventing part (23) and the protruding part (16) is less than the width (B) of the part (10) that is provided with the plurality of surrounding frangibly connected holes.

12. The coupling arrangement according to claim 1, wherein the outer coupling device (12) is arranged at a part of a pump housing (13) for a pump (6) with which the contents (3) can be pumped out of the package (1).

13. The coupling arrangement according to claim 1, wherein:

the central aperture (15) in the part (10) that is provided with the plurality of surrounding frangibly connected holes has a circular or essentially circular shape, and the tube section (14) has a shape that essentially corresponds to the shape of the central aperture.

14. The coupling arrangement according to claim 1, wherein at least the inner coupling device (9) consists of synthetic material.

15. The coupling arrangement according to claim 1, wherein the contents of the package (1) are liquid or half-liquid foodstuffs, such as, for example, ketchup, mustard, mayonnaise, dressing or similar.

16. The coupling arrangement according to claim 1, wherein the package (1) is a plastic bag.

17. The coupling arrangement according to claim 1, wherein the inner coupling device (9) comprises an inner part (24) with the shape of a ring that is coupled to the part (10) that is provided with the plurality of surrounding frangibly connected holes.

18. Coupling devices for the coupling of a withdrawal arrangement (4) to a package (1) from which the contents (3) are to be withdrawn with the aid of the withdrawal arrangement (4), wherein:

one coupling device is arranged as an inner coupling device (9) within an unbroken section (11) of a wall (2) of the package (1), the inner coupling device (9) comprising a part (10) provided with a plurality of surrounding frangibly connected holes having one central aperture (15), and an outer coupling device (12) that comprises a tube section (14) that breaks the unbroken part (11) of the wall (2) of the package (1) and is coupled to the inner coupling device (9) by being introduced into the central aperture (15) in the part (10) that is provided with the plurality of surrounding frangibly connected holes, the part (10) of the inner coupling device (9) that is provided with the plurality of surrounding frangibly connected holes comprises at least one of said plurality of surrounding frangibly connected holes (17) or a frangible section (18) of a wall of the inner coupling device, or both, and at least one protruding part (16) of the outer coupling device (12) can be introduced into said at least one of said plurality of surrounding frangibly connected holes (17) or said frangible section (18) of the wall can be broken by the protruding part (16), and either the central aperture (17) or the frangible section (18) of the wall for the protruding part (16), or both, allows the protruding part (16) to pass the part (10) that is provided with the plurality of surrounding frangibly connected holes in order to allow coupling together of the inner coupling device (9) and the outer coupling device (12).

19. The coupling devices according to claim 18, wherein the outer coupling device (12) comprises the protruding part (16), the outer coupling device (12) interacts with at least one coupling preventing part (23) that prevents the coupling together of the inner coupling device (9) and the outer coupling device (12) if the tube section (14) and the protruding part (16) are pressed by force into the central aperture (15) in the part (10) provided with the plurality of surrounding frangibly connected holes.

20. The coupling devices according to claim 19, wherein:

the coupling preventing part (23) is a part that is arranged next to the outer coupling device (12), and the distance (A) between the coupling preventing part (23) and the protruding part (16) is less than the width (B) of the part (10) that is provided with the plurality of surrounding frangibly connected holes.

21. The use of a coupling device in order to couple a withdrawal arrangement (4) to a package (1) from which the contents (3) are to be withdrawn with the aid of the withdrawal arrangement (4), wherein:

the coupling device includes as an inner coupling device (9) within an unbroken section (11) of a wall (2) of the package (1), the inner coupling device (9) comprising a part (10) provided with a plurality of surrounding frangibly connected holes having one hole central aperture (15), an outer coupling device coupled to the inner coupling device (9), the outer coupling device (12) comprising a tube section (14) that breaks the unbroken part (11) of the wall (2) of the package (1) and is to be coupled to the inner coupling device (9) by being introduced into the central aperture (15) in the part (10) that is provided with the plurality of surrounding frangibly connected holes, the part (10) of the inner coupling device (9) that is provided with the plurality of surrounding frangibly connected holes comprises at least one of said plurality of surrounding frangibly connected holes (17) or a frangible section (18) of a wall of the inner coupling device, or both, at least one protruding part (16) of the outer coupling device (12) is introduced into said at least one of said plurality of surrounding frangibly connected holes or the frangible section (18) of the wall is broken by the protruding part (16), or both, either the said at least one of said plurality of surrounding frangibly connected holes (17) or the frangible section (18) of the wall, or both, allows the protruding part (16) to pass the part (10) that is provided with the plurality of surrounding frangibly connected holes in order to allow coupling together of the inner coupling device (9) and the outer coupling device (12), and the inner coupling device (9) is used to couple to another outer coupling device, which comprises a tube section (14) that fits together with the central aperture (15) in the part (10) of the inner coupling device (9) that is provided with the plurality of surrounding frangibly connected holes but that lacks at least one protruding part (16).

* * * * *